US005507394A

United States Patent [19]

Laskowski et al.

[11] Patent Number: 5,507,394

[45] Date of Patent: Apr. 16, 1996

[54] AQUEOUS COMPOSITION USEFUL IN ORE FLOATATION CONTAINING ALIPHATIC AMINE, EXTENDER OIL, AND EMULSIFIER

[75] Inventors: Janusz S. Laskowski, Richmond; Oun Wang, Vancouver, both of Canada

[73] Assignee: The University of British Columbia, Vancouver, Canada

[21] Appl. No.: 249,514

[22] Filed: May 26, 1994

[51] Int. Cl.[6] ..... B03D 1/018; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,936,887 | 5/1960 | Wilson . | |
| 2,937,751 | 5/1960 | Schoeld . | |
| 3,424,310 | 1/1969 | Wilson | 209/166 |
| 3,844,939 | 10/1974 | Katayanagi | 209/166 |
| 5,122,289 | 6/1992 | Mackenzie et al. | 252/61 |

*Primary Examiner*—Thomas M. Lithgow

*Attorney, Agent, or Firm*—Richard P. Fennelly; Louis A. Morris

[57] ABSTRACT

A composition, adapted to be used in the flotation of ore fractions in aqueous suspension, consists essentially of: (a) water; (b) a hydrocarbon extender oil, preferably one having a low aromatics content; (c) a long chain aliphatic amine, such as a tallow-based amine, preferably one with an iodine value is less than about 20 cg/g; and (d) an acid emulsifier. This composition is prepared by the following successive steps: (a) dissolution of the amine in the oil at an elevated temperature, (b) addition of the acid to the aqueous phase, (c) addition of the oil containing the amine to the aqueous phase, and (d) emulsification of the mixture using an appropriate shearing.

13 Claims, No Drawings

AQUEOUS COMPOSITION USEFUL IN ORE FLOATATION CONTAINING ALIPHATIC AMINE, EXTENDER OIL, AND EMULSIFIER

BACKGROUND OF THE INVENTION

It is a general practice in flotation of coarse ore fractions to use an extender oil to assist the attachment of such particles to bubbles. This is especially important in potash ore flotation, in which high recovery of coarse potash minerals is required. Depending on mineral grain size, potash ores are ground to either −6 mesh (3.36 mm) or −8 mesh (2.38 mm) and are classified into +20 mesh (0.85 mm) coarse and −20 mesh fine streams. In order to achieve maximum recovery of the coarse particles, these two are reagentized separately and an extender oil is added to the conditioning of the coarse stream along with a long chain primary amine. The extender oil is commonly added into the flotation pulp without pre-emulsification.

Petroleum production heavy residues are commonly used as an extender oil for the flotation of coarse potash fractions. Because of high content of polycyclic aromatic compounds such extender oils are carcinogenic and much effort has been devoted to seek low carcinogenic replacement. Dissolving amine into some oils with low content of aromatics was found to produce a good extender oil. The use of oils containing long chain amine was tested in the flotation of coarse potash fractions [J. S. Laskowski and Q. Dai, Proc. 18th Int. Mineral Processing Congress, Sydney, 1993]. Further tests have revealed that the long chain amines dissolved in the oil should be characterized by higher saturation degree (or lower iodine value).

DESCRIPTION OF THE INVENTION

The present invention relates to an aqueous composition useful in ore flotation which consists essentially of: (a) water; (b) a hydrocarbon extender oil; (c) a long chain aliphatic amine; and (d) an acid emulsifier and to its method of formulation. The method comprises the following steps: (a) dissolving the amine in the extender oil at an elevated temperature; (b) adding an acid into water; (c) adding the oil containing the amine to the aqueous phase containing the acid; (d) emulsifying the two phases by high intensity shearing (or any other mixing). The hydrocarbon extender oil can comprise from about 0.1% to about 30%, by weight of the entire formulation, the amine from about 0.1% to about 30%, by weight of the oil, and the acid emulsifier from about 0.1% to about 10%, by weight of the formulation.

The hydrocarbon extender oil preferred for use herein is one having a low aromatics content (e.g., below about 40%, by weight, preferably below about 30–35%, by weight). A preferred extender oil is ESSO 2600 brand oil having a density of 0.90 g/cm$^3$ (at 15° C.), a kinematic viscosity of 310 cSt at 40° C. a molecular weight of 600, a saturates content of 69.5%, an aromatic content of 28.5%, a polar compound content of 1.4 wt %, 2.2 polars (clay gel analysis), a nitrogen content of 164 ppm and a sulfur content of 0.14 wt %.

The long chain aliphatic amine which forms one essential component of the present invention can be selected from known amine collectors known to persons of ordinary skill in the art of ore flotation. Generally speaking, such amines can be alkyl primary amines of the formula $RNH_2$, where R is a $C_8$ to $C_{22}$ alkyl group and/or an alkyl secondary amine of the formula $(R_1)(R_2)NH$, with $R_1$ and $R_2$ being independently an alkyl group such as previously defined for $R_1$ above. In regard to either type of amine, their water soluble salts, such as the acetate or chloride, may also be employed.

The acid emulsifier can be selected from carboxylic acids or mineral acids. Preferred species are acetic acid and hydrochloric acid.

The composition is formed by: (a) dissolving the amine in the extender oil at an elevated temperature; (b) adding an acid into water; (c) adding the oil containing the amine to the aqueous phase containing the acid; (d) emulsifying the two phases by high intensity shearing (or any other mixing).

The present invention is further illustrated by the Examples which follow.

EXAMPLE 1

This Example illustrates the advantage of the selected emulsification procedure. The following reagents were used: a hydrogenated tallow amine (ARMEEN HTD brand from Akzo Chemicals Inc.), a low aromatic extender oil (ESSO 2600 brand) and hydrochloric acid. A laboratory blender with a 1200 ml container and a blade free rotational speed up to 23,000 rpm was used as emulsifying device. A desired amount of the amine was dissolved in the oil by heating to about 80° C. The oil was then added to water at a desired pH adjusted with hydrochloric acid. The oil to water volume ratio in this Example was kept at 1:99. The liquids were then blended at the highest speed of the blender for one minute.

TABLE I

| Amine Addition | Amine: Oil (% w/v) | Initial pH (HCl) | Turbidity of Emulsion (cm$^{-1}$) | Amine Addition | Amine: Oil (% w/v) | Initial pH (HCl) | Turbidity of Emulsion (cm$^{-1}$) |
|---|---|---|---|---|---|---|---|
| In oil | 0.0 | 6.15 | 1.099 | In water | 0.0 | 3.98 | 2.153 |
| | 0.0 | 3.98 | 2.153 | | 0.0 | 2.51 | 2.676 |
| | 0.0 | 2.51 | 2.676 | | 1.0 | 3.48 | 4.261 |
| | 0.5 | 5.84 | 3.606 | | 1.0 | 1.98 | 4.479 |
| | 0.5 | 3.33 | 6.458 | | 2.0 | 3.59 | 4.567 |
| | 0.5 | 1.94 | 6.626 | | 2.0 | 1.96 | 4.687 |
| | 1.0 | 5.77 | 4.033 | | 4.0 | 3.58 | 4.721 |
| | 1.0 | 3.73 | 7.833 | | 4.0 | 1.95 | 4.491 |
| | 1.0 | 2.21 | 6.854 | | | | |
| | 2.0 | 5.84 | 4.194 | | | | |
| | 2.0 | 3.73 | 8.526 | | | | |
| | 2.0 | 2.16 | 3.354 | | | | |

Under favorable emulsification conditions, the oil could be entirely dispersed into the aqueous phase (otherwise, part of the oil stuck to the wall of the container). Some tests were carried out with the amine neutralized with hydrochloric acid in aqueous phase (instead of adding amine to oil phase).

Turbidity of the generated emulsions at 600 nm was used to characterize emulsification efficiency (Table I). Higher turbidity characterizes better emulsification. In the present case, a turbidity of about 7 to 8 $cm^{-1}$ corresponds to substantially complete emulsification.

As can be seen, a good emulsification of the extender oil was obtained when amine was dissolved in the oil and an acid was present in the aqueous phase to maintain the pH around 3 to 4. Ionized amine when present only in the aqueous phase could not efficiently emulsify the oil.

EXAMPLE 2

This Example illustrates the effect of type of amines and their saturation degree (iodine value) when the composition described in this invention was applied in the coarse potash flotation. The emulsion was prepared following the method described in Example 1. The oil to water volumetric ratio in the emulsions was 5:95. ESSO 2600 brand oil was used as the extender oil. Commercial amines (ARMEEN brands from Akzo Chemicals Inc.) with different chain length distributions and different iodine values were tested: (1) dodecylamine (ARMEEN 12D), (2) hexadecylamine (ARMEEN 16D), (3) octadecylamine (ARMEEN 18D), (4) hydrogenated tallow amine (ARMEEN HTD), (5) unhydrogenated tallow amine (ARMEEN TD), (6) oleic amine (ARMEEN OLD-C), (7) hydrogenated rapeseed amine (ARMEEN HR), and (8) a mixed hydrogenated long chain primary amine (ARMEEN HF). Acetic acid was added to the aqueous phase at a concentration of 5 ml/l A coarse fraction (−3.5+18 mesh or −5.6+1.0 mm) containing 35.9% KCl, 60.8% NaCl and 1.5% water-insoluble minerals was prepared from a sylvinite ore A by screening. The tests were carried out using the flotation column following conditioning of the potash particles in brine with 10 g/t carboxymethyl cellulose, 898 g/t of the extender oil containing 1% w/v of amine (10 g/t), and 167 g/t MIBC successively for four minutes. No additional amine was used.

TABLE II

| Amine | Mean chain length (Cn) | Iodine Value (cg/g) | Flotation Recovery (%) |
|---|---|---|---|
| ARMEEN 12D | 12.1 | 0.2 | 13.0 |
| ARMEEN 16D | 16.2 | 0.8 | 67.6 |
| ARMEEN 18D | 17.8 | 1.6 | 54.7 |
| ARMEEN HF | 20.0 | 4.3 | 56.0 |
| ARMEEN HR | 20.1 | 3.0 | 86.8 |
| ARMEEN 16D + 18D (2:3) | 17.1 | 1.3 | 89.2 |
| ARMEEN HTD | 17.2 | 3.0 | 77.2 |
| ARMEEN TD | 17.2 | 44.6 | 34.4 |
| ARMEEN OLD-C | 17.7 | 91.6 | 0.0 |

Concentrate grades were 97% ± 1% KCl.

Results shown in Table II reveal that the emulsion of this invention works well in some tests. It can further be seen that, when added to the extender oil, longer chain amines generally work better than shorter chain amines, and for amines with mean chain length close to that of a tallow amine, highly saturated amines are better than less saturated amines.

EXAMPLE 3

This Example illustrates the importance of emulsification of an extender oil in flotation of coarse potash fractions. The extender oil was ESSO 2600 brand oil containing ARMEEN brand amines. Emulsions were prepared following the procedure described in Example 1. The same coarse potash sample (−3½+18 mesh) prepared from ore A was tested. Well emulsified extender oil containing amine significantly improves flotation recovery of coarse potash fractions.

TABLE III

| Amine | Amine:Oil (% w/v) | Emulsification | HAc in Water (ml/l) | ESSO 2600 (g/t) | Amine (g/t) | Flotation Recovery (%) |
|---|---|---|---|---|---|---|
| ARMEEN HTD | 1 | no | | 450 | 5 | 23.8 |
| ARMEEN HTD | 1 | yes | 5 | 450 | 5 | 42.8 |
| ARMEEN HF | 10 | yes | 2 | 225 | 25 | 68.4 |
| ARMEEN HF | 10 | yes | 5 | 225 | 25 | 86.0 |
| ARMEEN HF | 10 | yes | 10 | 225 | 25 | 96.6 |

Concentrate grades were 97% ± 1% KCl.

EXAMPLE 4

Flotation of coarse fractions of four sylvinite ores was tested in the flotation column using the aqueous composition of this invention. Some results are given in Table III. Preparation of an emulsion of ESSO 2600 brand oil containing ARMEEN HTD and column flotation procedure are the same as described in Example 2. By using the method of the present invention high recoveries were obtained.

TABLE III

| Sample | | | Concentrate | | |
|---|---|---|---|---|---|
| Sample (Size Range) | KCl (%) | Water-Insoluble Minerals (%) | Collector Used | Grade (% KCl) | Flotation Recovery (%) |
| A (−3½ + 18 mesh) | 35.9 | 1.5 | 225 g/t ESSO 2600 oil (10% w/v ARMEEN HTD) | 96.5 | 96.5 |
| B (−6 + 18 mesh) | 33.4 | 6.8 | 900 g/t ESSO 2600 oil (4% w/v ARMEEN HTD) | 92.7 | 88.7 |
| C (−6 + 18 mesh) | 24.5 | 3.9 | 900 g/t ESSO 2600 oil (10% w/v ARMEEN HTD) | 85.6 | 88.6 |
| D (−6 + 18 mesh) | 38.6 | 2.3 | 900 g/t ESSO 2600 oil (4% w/v ARMEEN HTD) | 70.5 | 96.6 |
| D (−10 + 18 mesh) | 40.1 | 2.0 | 90 g/t ESSO 2600 oil (4% w/v ARMEEN HTD) + 6 g/t ARMEEN $HTD_{(aq)}$ | 78.6 | 93.2 |

The foregoing Examples, since they represent only certain embodiments of the present invention, should not be used to restrict the scope of protection to be accorded to that invention. The scope of protection sought is set forth in the claims which follow.

We claim:

1. An emulsified flotation composition, adapted to be used in the flotation of ore fractions in aqueous suspension, which consists essentially of: (a) water; (b) a hydrocarbon extender oil present in an amount from about 0.1% to about 30% by weight of the entire composition; (c) a long chain aliphatic amine present in an amount of from about 0.1% to about 30% by weight of extender oil; and (d) an acid emulsifier present in an amount of from about 0.1% to about 10% by weight of the entire composition.

2. A composition as claimed in claim 1 wherein the amine comprises a chain length of from about eight to twenty-two carbon atoms.

3. A composition as claimed in claim 2 wherein the amine is a tallow-based amine.

4. A composition as claimed in claim 1 wherein the composition comprises acetic acid as the acid emulsifier.

5. A composition as claimed in claim 1 wherein the oil has a low aromatics content.

6. A composition as claimed in claim 1 wherein the amine has an iodine number of less than about 20 cg/g.

7. A composition as claimed in claim 1 wherein the acid is a carboxylic acid.

8. A composition as claimed in claim 1 wherein the acid is a mineral acid.

9. A composition as claimed in claim 1 wherein the extender oil has a low aromatics content, the amine comprises a chain length of from about eight to about twenty-two carbon atoms, and the acid emulsifier is selected from the group consisting of a carboxylic acid and a mineral acid.

10. A composition as claimed in claim 9 wherein the amine has an iodine number of less than about 20 cg/g.

11. The flotation of coarse potash ore using the composition of claim 1.

12. The flotation of coarse potash ore using the composition of claim 9.

13. The flotation of coarse potash ore using the composition of claim 10.

* * * * *